US005146626A

United States Patent [19]

Rosado

[11] Patent Number: 5,146,626

[45] Date of Patent: Sep. 15, 1992

[54] INTERCHANGEABLE DECORATIVE FRONT PIECE FOR A GARMENT

[76] Inventor: Zonguie Rosado, 21 Victor Braegger, Villa Caparra, Guaynabo, P.R. 00657

[21] Appl. No.: 658,524

[22] Filed: Feb. 21, 1991

[51] Int. Cl.[5] ..... A41B 1/22

[52] U.S. Cl. ..... 2/105; 2/119; 2/133

[58] Field of Search ..... 2/105, 106, 118, 119, 2/121, 122, 133, 139, 244, 49 R, 107, 103, 91

[56] References Cited

U.S. PATENT DOCUMENTS

| | | | |
|---|---|---|---|
| 46,567 | 2/1865 | Lockwood | 2/119 |
| 264,506 | 9/1882 | Axell | 2/119 |
| 282,234 | 7/1883 | Stark | 2/119 |
| 310,691 | 1/1885 | Lee | 2/119 |
| 322,502 | 7/1885 | Thal | 2/139 |
| 408,850 | 8/1889 | Powers | 2/133 |
| 652,164 | 6/1900 | Butz | 2/119 |
| 1,827,716 | 10/1931 | Snow | 2/119 |
| 1,960,312 | 5/1934 | Landorf | 2/133 |
| 2,164,751 | 7/1939 | Newman | 2/139 |
| 2,556,039 | 6/1951 | Landert | 2/119 |
| 2,647,261 | 8/1953 | Rassner | 2/246 |
| 2,688,136 | 9/1954 | Freedman | 2/122 |
| 2,707,786 | 5/1955 | Stoner | 2/105 |
| 2,747,194 | 5/1956 | Ranieri | 2/119 |
| 3,064,265 | 11/1962 | Bridgewaters | 2/105 |
| 4,754,500 | 7/1988 | Brucato et al. | 2/105 |

FOREIGN PATENT DOCUMENTS

| | | | |
|---|---|---|---|
| 298766 | 4/1916 | Fed. Rep. of Germany | 2/133 |
| 341067 | 9/1921 | Fed. Rep. of Germany | 2/119 |
| 6020 | 5/1893 | United Kingdom | 2/119 |
| 434650 | 9/1935 | United Kingdom | 2/133 |
| 761732 | 11/1956 | United Kingdom | 2/139 |

*Primary Examiner*—Werner H. Schroeder
*Assistant Examiner*—Amy Brooke Vanatta
*Attorney, Agent, or Firm*—Oblon, Spivak, McClelland, Maier & Neustadt

[57] ABSTRACT

A single dress of simple design is selectively changed into entirely different dresses by changing decorative front pieces which are located on the front of the dress by a rear flap sewed along a line of stitching corresponding in shape to that of a neckline and tucked behind the neckline to hold the respective dress front pieces of different design in place.

8 Claims, 3 Drawing Sheets

INTERCHANGEABLE DECORATIVE FRONT PIECE FOR A GARMENT

FIELD OF THE INVENTION

This invention relates to garments and more particularly to means and a method for selectively and radically altering the appearance of a single garment.

BACKGROUND OF THE INVENTION

Fashion, dictates that women should own a basic black dress having usually a circular, U-shaped or Vee shaped neck. The appearance of the same dress may be altered for different functions by the use of jewelry but no matter how much the jewelry may be changed, the appearance of the basic black dress remains unchanged and in order not to give the impression that one owns only one dress for certain types of functions, a woman may have a number of dresses all basically the same black dress but each having a distinctive appearance from the others by the use of different front pieces which are permanently attached to the dress. Having several dresses of the same basic design but differing only by distinctive front pieces is expensive and can also create storage problems.

Dresses with removable collars are well known. However, the collar is usually removable for laundering purposes only and there is no intention that it be capable of altering a single dress so that it appears to be a variety of radically different dresses.

BRIEF DESCRIPTION OF THE INVENTION

The aim of the present invention is to permit a woman to own only one or two or, at most, three similar dresses differing only by the shape of the neckline. The total appearance of any one of the dresses may be changed by simply changing the front piece of the dress to another of a radically different configuration with each front piece, in accordance with the invention, presenting the appearance of being a permanent part of the dress, novel connecting means being provided to ensure that the front piece does not slip from its intended position on the dress.

Thus one object of the invention is to provide a dress front piece construction which enables the quick and secure total alteration of the appearance of a basic dress.

Another object of the invention is to provide a method for altering the appearance of a basic dress.

Figure 1:
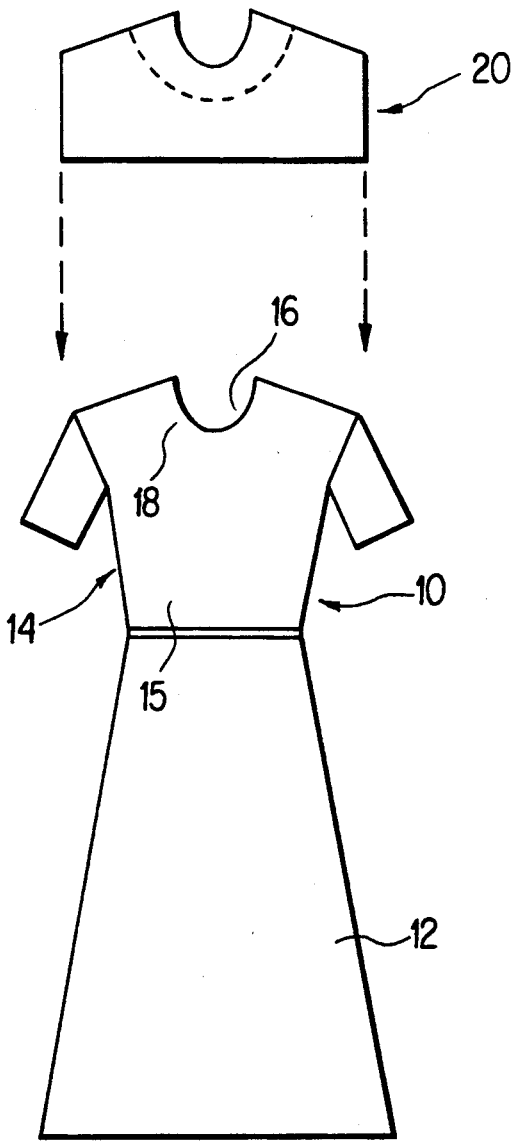
FIG. 1 is a front elevational view of a basic dress having a U-shaped neck and showing the manner in which a front piece of any configuration is attached to the dress.

Referring now to the drawings, the numeral 10 refers to a garment which may be a basic dress having a skirt part 12 and an upper part 14 having a normally exposed front part 15. The garment has a neck encircling part 16 at least the front part 18 of which is cut to a predetermined shape which, in FIG. 1, is U-shaped.

Figure 2:
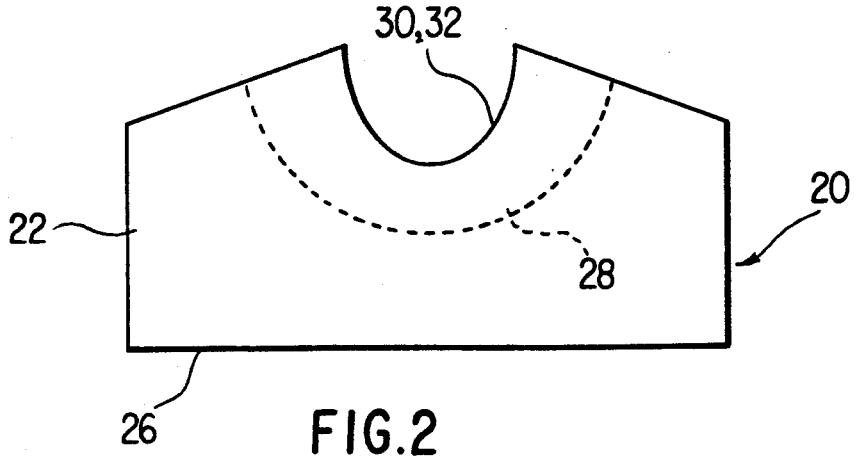
FIG. 2 is an enlarged front elevational view of the dress front piece of FIG. 1.

FIG. 2 is intended to represent an interchangeable front piece 20 for the dress 1C. The front pieces illustrated in the drawings are shown plain but this is because there is no limit to the various configurations which a front piece is susceptible of. For example, it may be a large brightly colored bow supported on a bib-like under layer of a color contrasting with the bow and dress. Another possible configuration is a large scarf-like member of vivid color which extends from shoulder to shoulder across the front of the dress. These are mere examples; the possible variations are too myriad to list but common to all is that they are of a size to cover a substantial portion of the exposed front part 15 of the dress between the waist and neck of the wearer and of a configuration and color that they constitute, or give the appearance of constituting, an actual permanent front piece of a dress thus permitting the same dress to serve as several different dresses at minimum expense. From this it can be seen that simple removable collars are excluded from the term "front piece" of a dress simply because they are incapable of giving the appearance that the same dress is several different dresses.

Figure 4:
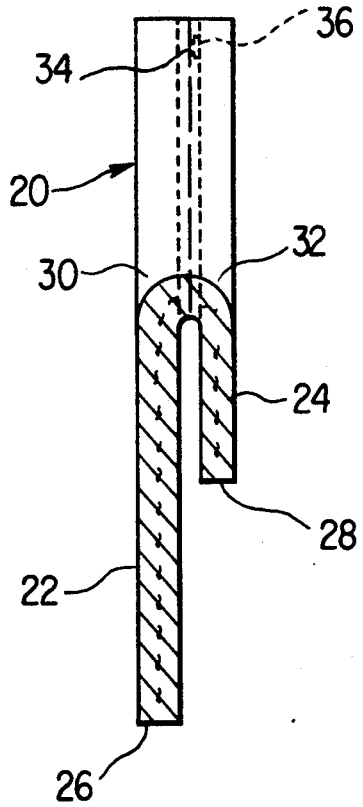
FIG. 4 is an enlarged vertical cross sectional view taken substantially on the line 4—4 of FIG. 3.
Figure 5:
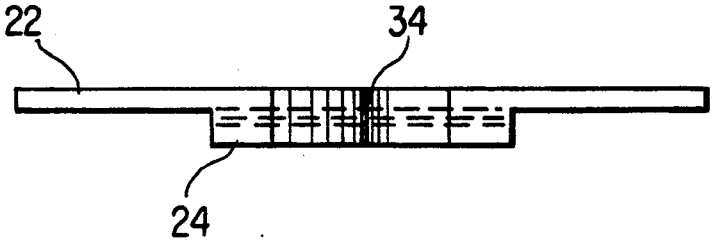
FIG. 5 is a top plan view of the dress front piece of FIG. 3.

The interchangeable front piece 20, as best seen in FIG. 4, comprises a decorative front flap 22 of a size to cover a substantial portion of the exposed front part of the garment, and a rear flap 24. The flaps 22, 24 have free outer edges 26, 28 and inner edges 30, 32 which are cut to conform substantially to the same shape as the front part of the dress neckline 18. The inner edges 30, 32 are joined together by a line of connection 34, which may be a line of stitching as best seen in FIG. 4, with the flaps 22, 24 extending from the line of connection 34 in overlapping substantially parallel relationship as best seen in FIG. 4. The rear flap 24 is constructed and arranged to be tucked behind the neckline 18 of the garment 10 with the line of connection 34 in engagement with the shaped front part 18 of the garment and with the front flap 22 covering a substantial portion of the normally exposed front part 15 of the garment. As should be clear from the figures, the front flap 22 extends a substantial distance below the rear flap 24 and also may extend a substantial distance to either side of the rear flap 24 whereby the front flap covers a substantial portion of the normally exposed front of the dress to totally alter the appearance of the dress as would be impossible with a mere removable collar.

Figure 6:
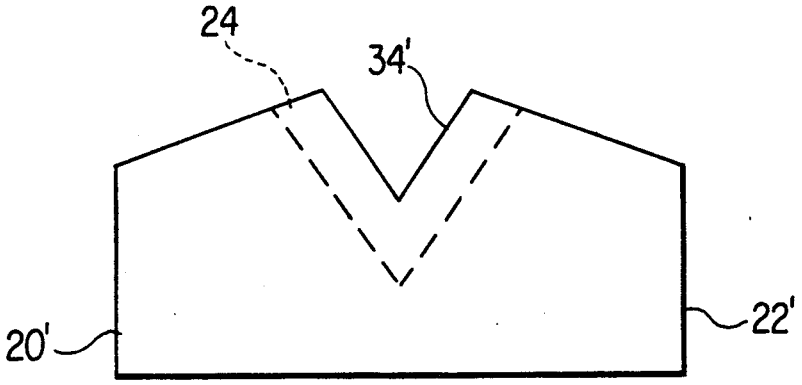
FIG. 6 is a front elevational view of a piece for use with a dress having a V-shaped neckline.

FIG. 6 illustrates a decorative front piece 20' wherein the line of connection 34' between front and rear flaps 22', 24' is V-shaped for use with a garment having a V-shaped neckline.

Figure 7:
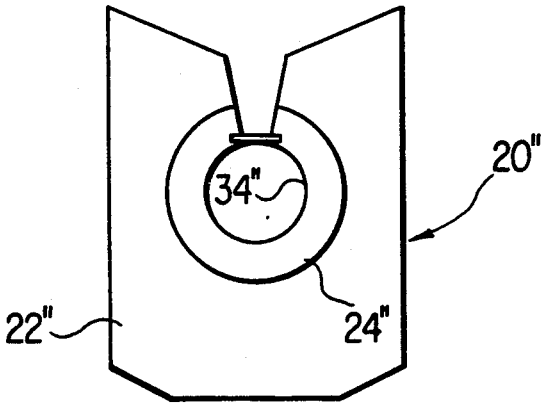
FIG. 7 is a rear elevational view of a front piece for use with a dress having a circular collar.

FIG. 7 illustrates a decorative front piece 20" wherein the line of connection 34" between front and rear flaps 22" and 24" is circular for use with a garment having a circular neckline.

Figure 3:
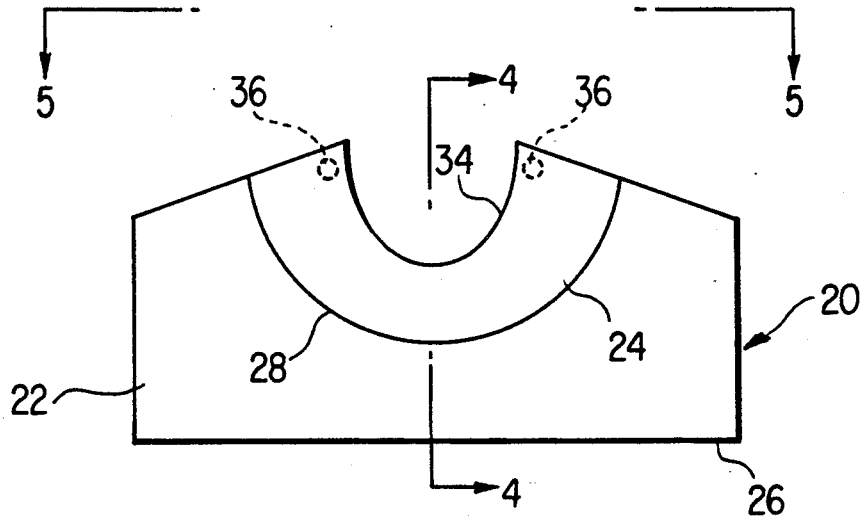
FIG. 3 is a rear elevational view of the dress front piece of FIG. 2.

As can be seen in FIGS. 3 and 4 it may be desirable to connect releasable fastening means, such as one part of a snap fastener 36, to the inner face of the rear flap 24 in a location, such as the upper inner extremity of the rear flap 24 as shown in FIG. 3, for cooperation with mating fastening means complementary located on the inner side of the garment.

The method of the invention comprises selectively altering the appearance of a garment, such as the dress 10, having a front part 15 which includes a neckline 16 cut to a predetermined shape, such as the U-shape shown in FIG. 1, comprising the steps of sewing to each of a plurality of different decorative front flaps a rear flap along a line of stitching conforming to the predetermined shape of the neckline so that the rear flap overlaps in substantially parallel relationship the front flap. The rear flap is tucked behind the neckline of the garment and the appearance of the garment is changed by replacing the front flap with a second decorative front flap by tucking its rear flap behind the neckline.

Though the application describes the invention as it applies to ladies dresses, the invention is not limited to such use but may be used to vary the appearance of any garments for any use, as for example, men's and children's garments. Where, in the claims, reference is made to the "exposed front part of the garment" this shall be limited to mean that portion 15 of the front of the garment between the wearer's neck and waist and which is exposed to view.

Having described the invention what is claimed is:

1. For use with a garment having a front part which, in use, extends between the neck and waist of a wearer and is normally exposed to view, said garment including a neck encircling neckline the front part of which is cut to a predetermined shape, an interchangeable decorative front piece for said garment comprising a decorative front flap of a size to cover a substantial portion of the exposed front part only of said garment and a doubled over rear flap located behind said front flap, said flaps having free outer edges and inner edges cut to conform substantially to the same shape as said front part of said neckline of said garment and being joined together by a line of connection, said flaps extending from said line of connection in overlapping substantially parallel relationship, said rear flap being constructed and arranged to be tucked behind said front part of said neckline of a garment with said line of connection in engagement with said front part of the neckline of said garment and said front flap covering a substantial portion of the normally exposed front part of said garment, said line of connection with said front part of said neckline providing substantially the sole support of said decorative front piece on said garment.

2. The decorative front piece of claim 1 wherein said line of connection is V-shaped for use with a garment having a neckline the front part of which is V-shaped.

3. The decorative front piece of claim 1, wherein said line of connection is U-shaped for use with a garment having a neckline the front part of which is U-shaped.

4. The decorative front piece of claim 1, wherein said line of connection is circular for use with a garment having a neckline the front part of which is circular.

5. The decorative front piece of claim 1, wherein at least said decorative front flap is of cloth fabric.

6. The decorative front piece of claim 1, wherein both said flaps are of cloth fabric.

7. The decorative front piece of claim 1, including releasable fastening means connected to said rear flap in a location for cooperation with mating fastening means complimentarily located on the inner side of said garment.

8. The decorative front piece of claim 1, wherein said line of connection is a line of stitching.

* * * * *

UNITED STATES PATENT AND TRADEMARK OFFICE

CERTIFICATE OF CORRECTION

PATENT NO. : 5,146,626

DATED : September 15, 1992

INVENTOR(S) : Maria M. Rosado

It is certified that error appears in the above-identified patent and that said Letters Patent is hereby corrected as shown below:

On the Title page, item

[76] Inventor: change "Zonguie Rosado to--Maria M. Rosado--.

Signed and Sealed this

Twenty-eighth Day of September, 1993

Bruce Lehman

*Attest:*

BRUCE LEHMAN

*Attesting Officer*

*Commissioner of Patents and Trademarks*